United States Patent [19]

Kato et al.

[11] 4,407,898

[45] Oct. 4, 1983

[54] CORNER PAD

[75] Inventors: Hideo Kato; Hiroto Wada, both of Tokyo, Japan

[73] Assignee: Fukuoka Paper Manufacturing Co., Ltd., Fukuoka, Japan

[21] Appl. No.: 351,880

[22] Filed: Feb. 24, 1982

[51] Int. Cl.[3] ..... B65D 81/02

[52] U.S. Cl. ..... 428/542.8; 206/453; 206/586; 229/DIG. 1; 248/345.1

[58] Field of Search ..... 428/542.8, 121; 206/453, 586; 229/DIG. 1; 248/345.1

[56] References Cited

U.S. PATENT DOCUMENTS

| | | | |
|---|---|---|---|
| 3,356,209 | 12/1967 | Pezely, Jr. | 206/523 |
| 3,361,322 | 1/1968 | Gabriel et al. | 206/586 X |
| 4,287,265 | 9/1981 | McKnight | 428/218 |

*Primary Examiner*—Henry F. Epstein

*Attorney, Agent, or Firm*—Watson, Cole, Grindle & Watson

[57] ABSTRACT

An improved corner pad is provided which is adapted to be applied to a corner of a cubic or rectangular parallelopipedal article, for example, a speaker box or the like for the purpose of protecting the corner of the article in packaging it into a packing box such as a corrugated cardboard box or the like for transporting or storing it.

13 Claims, 12 Drawing Figures

CORNER PAD

TECHNICAL FIELD

This invention relates to an improved corner pad adapted to be applied to a corner of a cubic or rectangular parallelopipedal article, for example, a speaker box or the like for the purpose of protecting the corner of the article in packaging it into a packing box such as a corrugated cardboard box or the like for transporting or storing it.

BACKGROUND ART

In hitherto used corner pads, it has been proposed to form previously a three-faced body of a formable synthetic resin adapted to be applied to a corner of a speaker box or the like, or a thick three-faced body formed by bonding a few pieces of corrugated cardboard.

With these conventional bodies, however, as they are already formed in three-faced bodies before being used, they are bulky to be inconvenient for transporting or storing them. Moreover, as they exhibit only poor restoration to original shapes when external forces are removed one they have been collapsed by the external forces in use, they must be formed to have great thicknesses which result in bulky packages as a whole.

DISCLOSURE OF INVENTION

It is an object of the invention, therefore, to provide a corner pad which eliminates the above disadvantages of the prior art and which is compact for transporting and storing and has a great shock absorbing effect in use.

This object is achieved by the corner pad according to the invention, which comprises four substantially square disc-like hollow bodies made of a synthetic resin arranged substantially in a checkboard pattern, all but one adjacent set of the hollow bodies being connected to each other along their adjacent edges by foldable pieces so as to form a three-faced body whose respective surfaces are substantially at right angles to each other in an erected condition by folding said four hollow bodies at the foldable pieces, and the two hollow bodies to be superposed in said erected condition being formed respectively with a protrusion and an opening fitting engageable with each other in said erected condition of said two hollow bodies.

It is another object of the invention to provide a corner pad adapted to be simply and reliably secured to an inner bottom plate and an inner cover plate of a packing box or an inner flap of a corrugated cardboard box or the like.

BEST MODE FOR CARRYING OUT INVENTION

Figure 1:
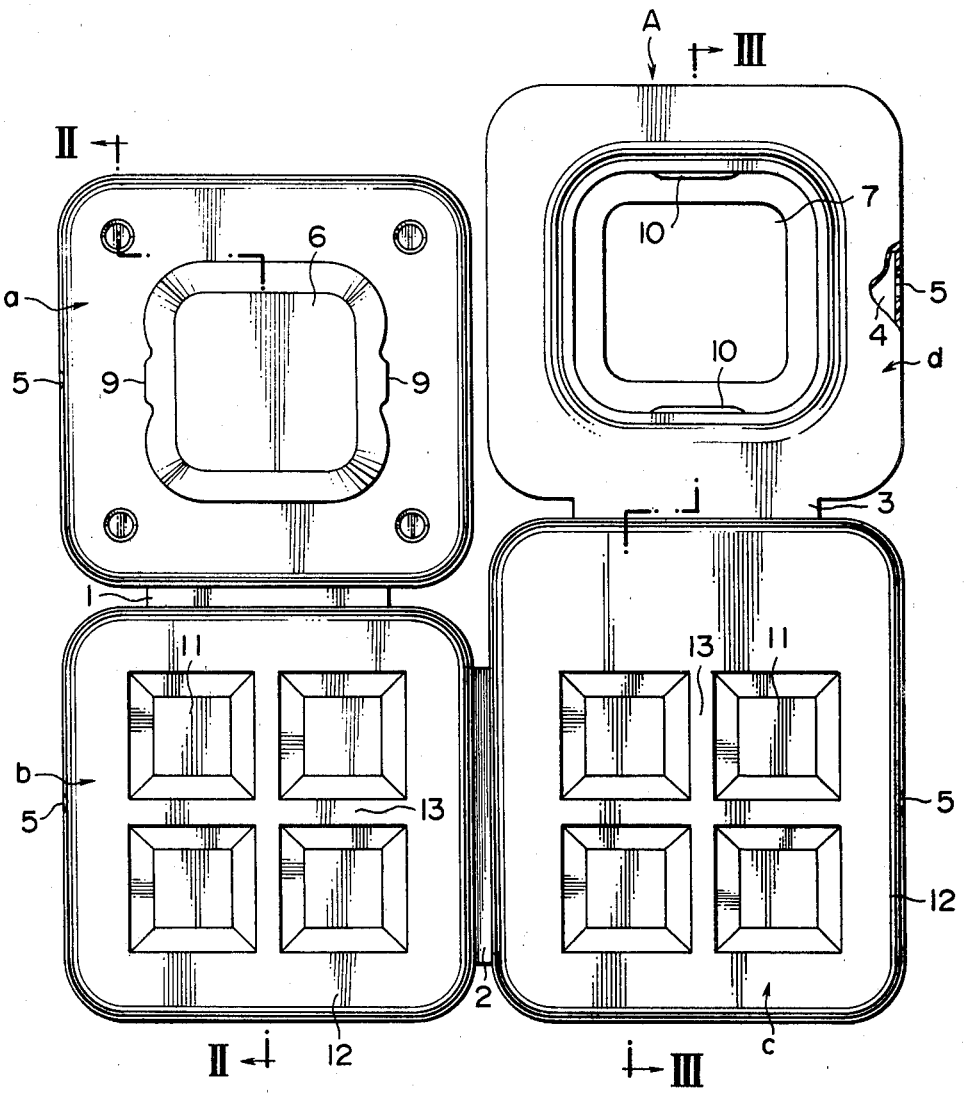
FIG. 1 is a plan view of a corner pad according to the invention shown in a developed condition.
Figure 2:
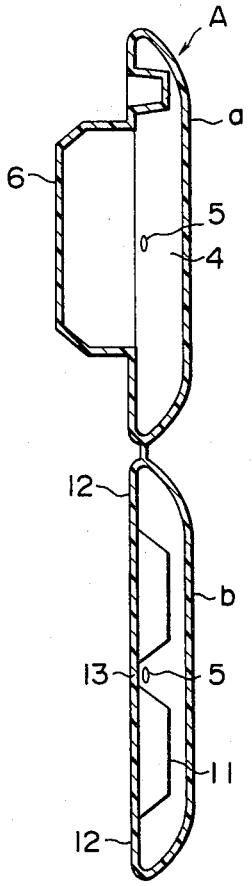
FIG. 2 is a sectional view taken along lines II—II in FIG. 1.
Figure 3:
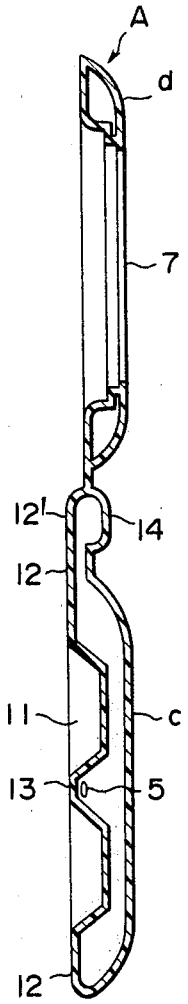
FIG. 3 is a sectional view taken along lines III—III in FIG. 1.
Figure 4:
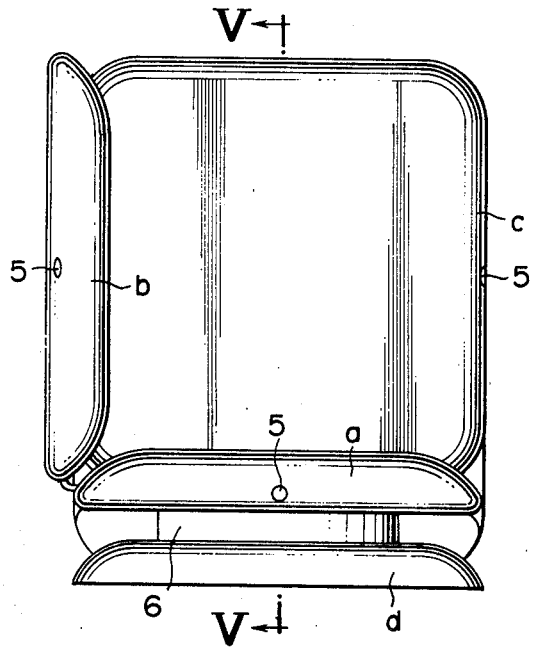
FIG. 4 is an elevation of the corner pad shown in FIG. 1 in an erected condition.
Figure 5:
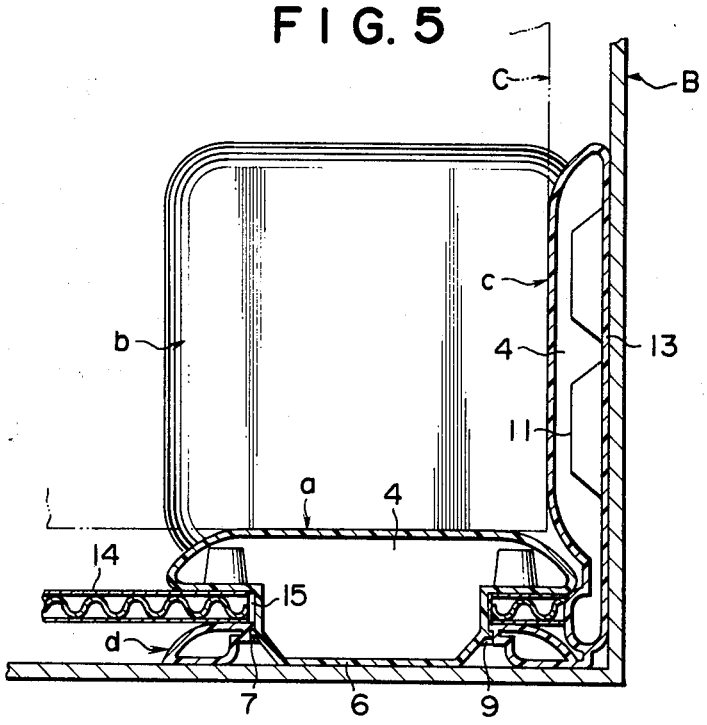
FIG. 5 is a sectional view taken along a line V—V in FIG. 4 illustrating the corner pad in a used condition.

In the drawings, a corner pad body (A) consists of four hollow bodies (a), (b), (c) and (d) connected by foldable pieces (1), (2) and (3) and integrally formed of a synthetic resin with a suitable elasticity by blow molding.

The first, second, third and fourth hollow bodies (a), (b), (c) and (d) are plane square hollow plates. The first and second hollow bodies (a) and (b) are connected to each other with respective adjacent side edges by the foldable piece (1). The third hollow body (c) is connected to the second hollow body (b) by the foldable piece (2) perpendicular to the foldable piece (1). Further, the fourth hollow body (d) is connected to the third body (c) on the side of the first hollow body (a) by the foldable piece (3) perpendicular to the foldable piece (2) connecting the second and third hollow bodies (b) and (c).

Each of the hollow bodies (a), (b), (c) and (d) is formed in a side with a small aperture (5) communicating with an inner space (4) in the hollow body.

The first, second and fourth hollow bodies (a), (b) and (d) are formed in the same size. The third hollow body (c) is longer on its side connected to the fourth hollow body (d) by a distance equivalent to the sum of thicknesses of the first and fourth hollow bodies (a) and (d) than the other hollow bodies (a), (b) and (d), so that the third hollow body (c) extends by the distance beyond the position of the adjacent sides of the first and second hollow bodies (a) and (b) towards the fourth hollow body (d).

With this arrangement, when the corner pad body (A) is folded along the foldable pieces (1), (2) and (3) so as to superpose the fourth hollow body (d) upon the first hollow body (a) to form a three-faced body having three surfaces substantially perpendicular with one another which are fitable with a corner of a body to be protected in the form of a cube or rectangular parallelopiped such as a speaker box or the like.

The corner pad body (A) includes a protrusion (6) extending from the first hollow body (a) on the side of the fourth hollow body (d) and an opening (7) extending through the entire thickness of the fourth hollow body (d).

The protrusion (6) extends in the form of a square from the first hollow body (a) except an outer peripheral portion having a suitable width from peripheral edges thereof. The protection (6) has a height being somewhat higher than the thickness of an inner flap (8) or inner bottom plate or inner cover plate of a packing box such as a corrugated cardboard box and is provided on a pair of opposite edges or all the edges of the peripheral surfaces of the protrusion with engaging pieces (9) in the form of a notch at a location substantially equivalent to the thickness of the inner flap or the like from the bottom of the protrusion (6).

The opening (7) is formed in the fourth hollow body (d) except the outer peripheral portion thereof corresponding in width to the outer peripheral portion of the first hollow body (a) about the protrusion (6) and commensurate in configuration and size with the protrusion (6). The fourth hollow body (d) is also formed with engaging pieces (10) in the form of a latch extending inwardly of the opening on a pair of edges in opposition to each other or all the edges on the side of the surface adjacent to the first hollow body (a) when the corner pad body (A) is erected in the three-faced body.

Accordingly, when the corner pad body (A) is erected in the three-faced body, the protrusion (6) is fitted to the opening (7) to maintain the overlap of the first and fourth hollow bodies (a) and (4) and hence the erected three-faced body and the engaging pieces (9) and (10) formed on the protrusion (6) and opening (7) are engaged with each other to securely maintain the three-faced body in its erected condition.

Without the engaging pieces, as an alternative, after the protrusion (6) is fitted in the opening (7), the end of the protrusion is collapsed by fingers so as to extend outwardly to ensure the maintaining of the three-faced body.

In this manner, the corner pad according to the invention is used as a three-faced body mating with a corner of an article to be protected in the form of a cube or rectangular parallelopiped. In unused condition, the corner pad is kept flat, which is not bulky and advantageous for transporting and storing in comparison with conventional corner pads which have been previously erected.

Furthermore, the second and third hollow bodies (b) and (c) of the corner pad body (A) according to the invention are formed with recesses (11) in their outer surfaces when the corner pad body is erected in a three-faced body.

The second and third hollow bodies (b) and (c) include pheripheral portions (12) except the recesses in the outer surfaces.

As the third hollow body (c) is formed longer than the second hollow body (b), the peripheral portion (12) of the former on its connected side to the fourth hollow body (d) is wider by the elongated portion (12') of the body (c). The third hollow body (c) is also formed in the opposite surface of the portion (12'), that is, on the inner side of the three-faced body, with a ridge (14) extending in a lengthwise direction of the portion (12').

Such a corner pad body (A) is erected into a three-faced body which is applied to a corner portion of a cubic or rectangular parallelopipedal article (c) such as a speaker box or the like to be protected. As above described, each hollow body of the corner pad abutting against the corner portion of the article to be protected is a hollow disc of a blown formed synthetic resin having a suitable elasticity, so that although it is not very thick, it can effectively damp or absorb an outer pressure such as impact from the exterior to achieve a compact packaging of an article.

Moreover, as the corner pad (A) according to the invention includes small apertures communicating with the inner spaces of the hollow bodies, it functions as a pneumatic bumper to improve its shock absorbing effect and when the applied external pressure is removed, air is again filled in the inner space through the small apertures in place of the exhausted air thereby to restore the hollow bodies to their original condition, so that if the external pressure is repeatedly applied several times, the corner pad everytime positively absorbs the external pressure.

In applying the corner pad (A) to the corner portion of an article (c) to be protected, moreover, the corner pad may be attached to the inner flap (14) or inner bottom plate or inner cover plate of a packing box such as a corrugated cardboard box or the like for packing the article (c).

In other words, the inner flap (14) or the like is formed in position with an opening (15) through which the protrusion (6) of the first hollow body (a) extends outwardly to erect the corner pad body (A) into the three-faced body in a manner such that the flap (14) or the like is embraced by the first and fourth hollow bodies (a) and (d).

Accordingly, the corner pad (A) can be simply secured to the inner flap (14) or inner bottom plate (16) of a packing box (B) without using an adhesive or the like to eliminate a loss of time required to dry the adhesive.

In addition, when the corner pad (A) is applied to a corner portion of an article (C) to be protected with the aid of the inner flap (14) or inner bottom plate (16), the two hollow bodies (a) and (d) doubly protect the upper and lower surfaces of the article (C) with a great protecting effect where the article is likely to be most subjected to the loads or external forces.

Figure 6:
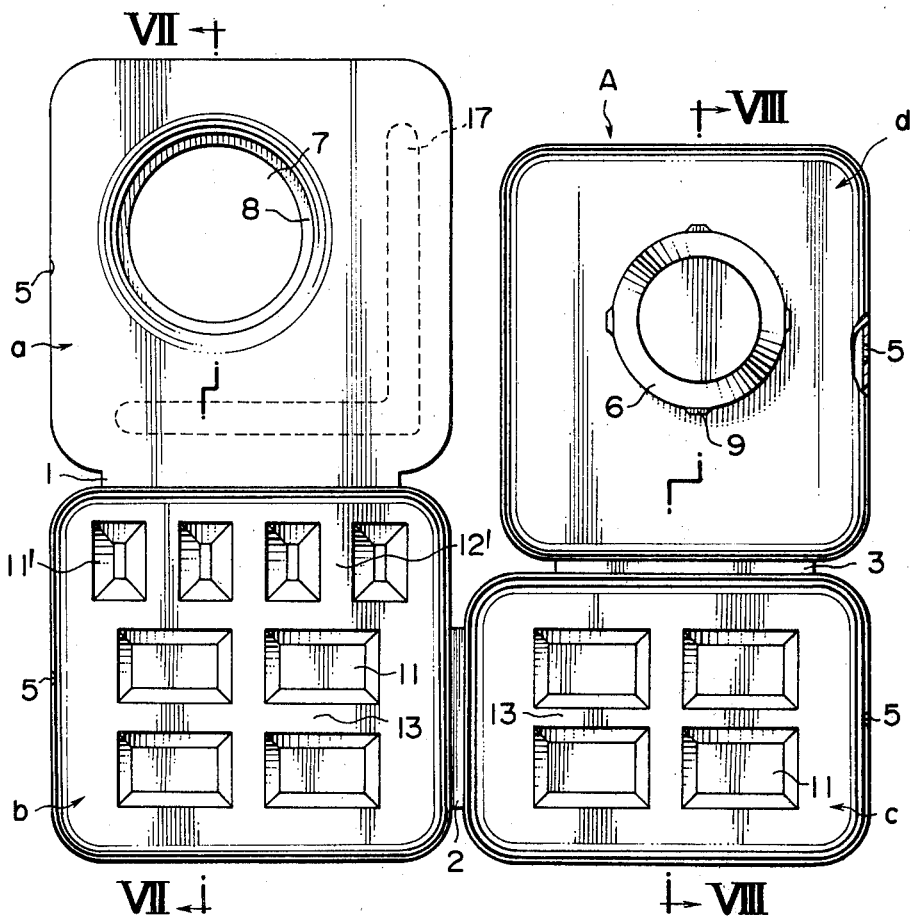
FIG. 6 is a plan view of a corner pad of another embodiment of the invention in a developed condition.
Figure 7:
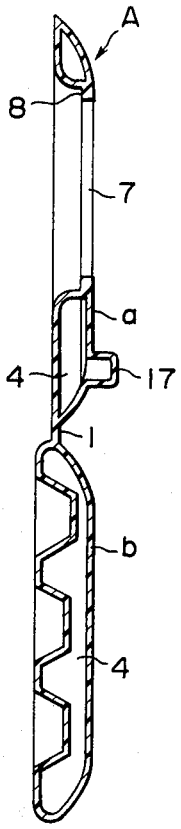
FIG. 7 is a sectional view taken along lines VII—VII in FIG. 6.
Figure 8:
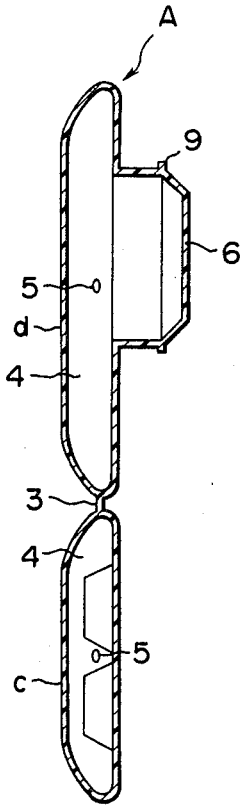
FIG. 8 is a sectional view taken along lines VIII—VIII in FIG. 6.
Figure 9:
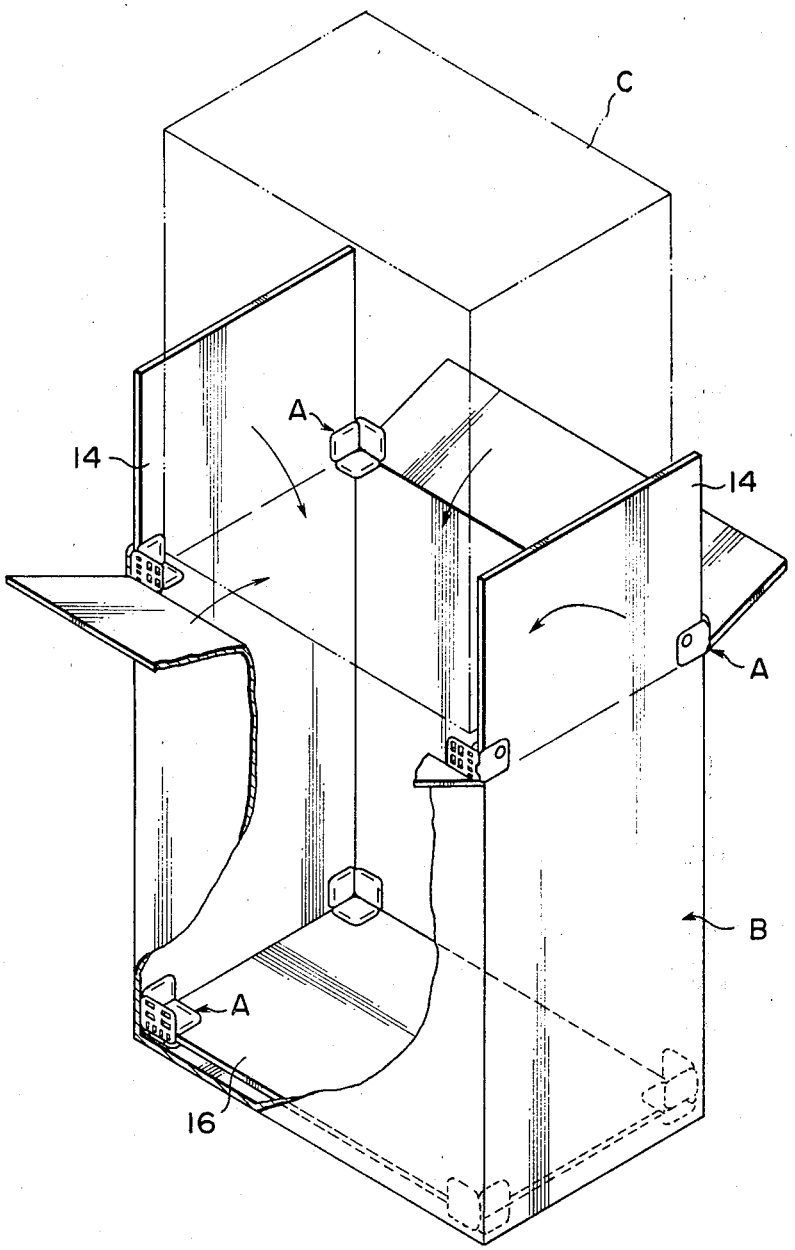
FIG. 9 is a perspective view of a packing box with the corner pads shown in FIG. 6 secured to inner flaps and inner bottom plates of the box.
Figure 10:
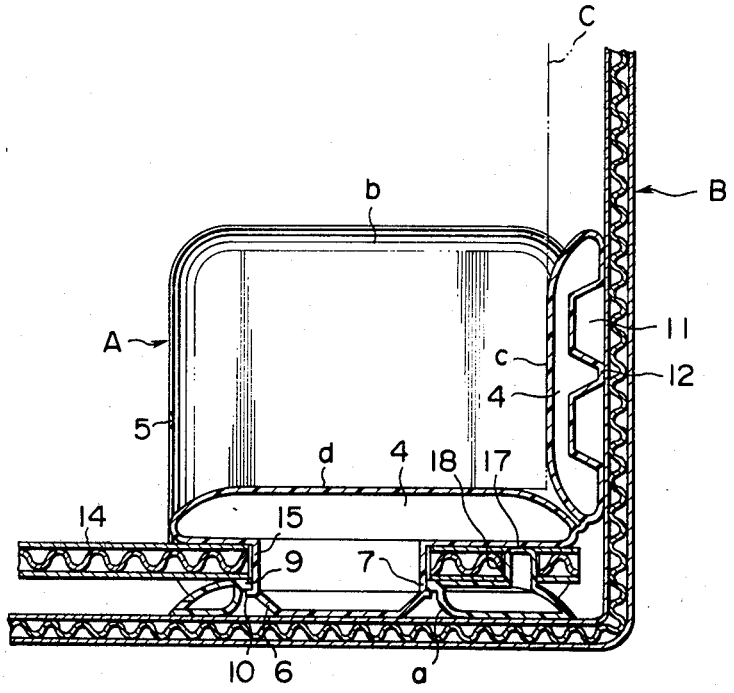
FIG. 10 is an enlarged sectional view illustrating the corner pad shown in FIG. 6 secured to a lower inner flap of a packing box.
Figure 11:
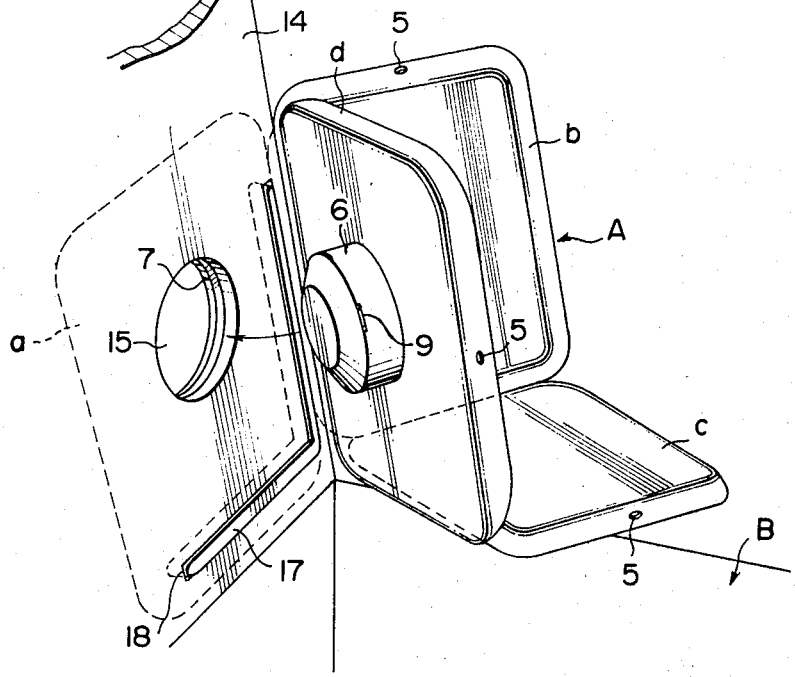
FIG. 11 is a perspective view explanatorily illustrating a secured condition of the corner pad to an upper inner flap of a packing box.
Figure 12:
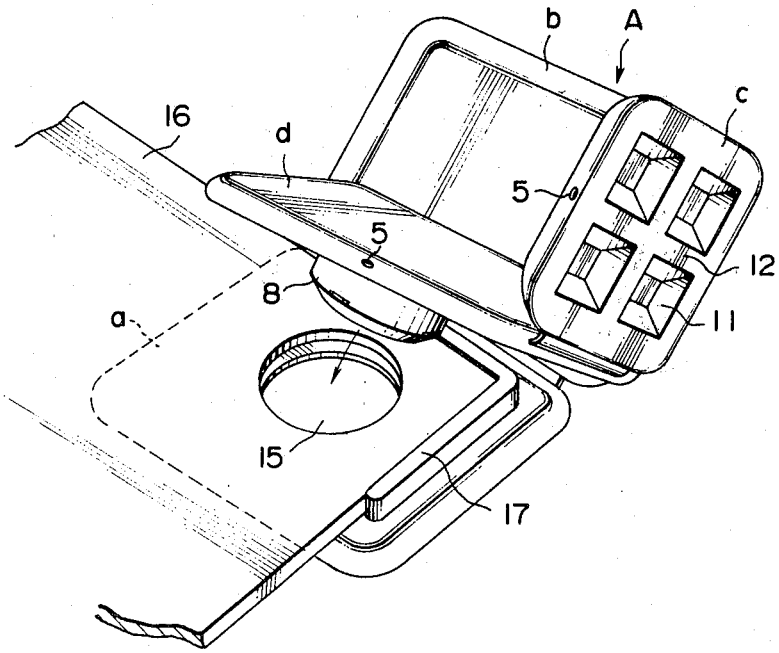
FIG. 12 is a perspective view explanatorily illustrating a secured condition of the corner pad to an inner bottom plate of a packing box.

In the embodiment shown in FIGS. 6–12, first, second and fourth hollow bodies (a), (b) and (d) are formed in substantially the same size, but a third hollow body (c) is formed somewhat smaller than the first, second and fourth hollow bodies (a), (b) and (d). Namely, the third hollow body (c) is shorter in a direction adjacent to the fourth hollow body (d) by a sum of a thickness of the first hollow body (a) and a thickness of a reinforcing ridge (17) formed on the first hollow body (a) later desiribed than the other hollow bodies (a), (b) and (d).

A protrusion (6) is formed in the fourth hollow body (d) and an opening (7) is in the first hollow body (a).

The corner pad in this embodiment is, therefore, erected into a three-faced body with the first hollow body (a) outwardly superposed upon the fourth hollow body (d).

The reinforcing ridge (17) is formed on the surface of the first hollow body (a) to be superposed on the fourth hollow body (d), and extending in the form of an L-shaped protrusion whose legs are adjacent to and along the two edges of the first hollow body respectively adjacent to the second and fourth hollow bodies (b) and (d). The height of the reinforcing ridge (17) corresponds to a thickness of an innner flap (14) or inner bottom plate (16) of a packing box (B) such as a corrugated cardboard box.

The reinforcing ridge (17) is not only capable of course of increasing the strength of the corner pad (A) but also exactly positioning the corner pad (A) and preventing it from wandering or shifting after applied, by fitting the reinforcing ridge (17) in an L-shaped opening (18) previously punched in the inner flap (14) or applying the reinforcing ridge (17) to a corner of the inner bottom plate (16).

The recesses (11) are formed in the second and third hollow bodies (b) and (c). The portion of the second hollow body (b) adjacent to the first hollow body (a) is formed with the recesses (11') particularly more in number than those in the other portions. The recesses (11') are formed deep to an extent approaching to the opposite surface of the hollow body while the recesses (11) in other portions have a depth about a half of the thickness of the hollow body.

The portion of the second hollow body (b) adjacent to the first hollow body (a) is therefore reinforced by reinforcing ribs (12') which are more in number and have a higher strength than those in other portions to prevent that portion from being pierced and damaged by a corner portion of an article (C) to be protected.

While the invention has been described in detail with reference to preferred embodiments thereof, it will be understood by those skilled in the art that the foregoing and other changes in form and details can be made therein without departing from the spirit and scope of the invention.

We claim:

1. A corner pad comprising four substantially square hollow bodies made of a synthetic resin arranged substantially in a checkerboard pattern, all but one adjacent set of the hollow bodies being connected to each other along their adjacent edges by foldable pieces so as to form a three-faced body whose respective surfaces are substantially at right angles to each other in an erected condition by folding said four hollow bodies at the foldable pieces, and the two hollow bodies to be superposed in said erected condition being formed respectively with a protrusion and an opening fitting engageable with each other in said erected condition to retain the superposed condition of said two hollow bodies.

2. A corner pad as set forth in claim 1, wherein peripheral surfaces of said protrusions and edges of said opening are formed with engaging pieces in the form of latches extending therefrom and engageable and disengageable from one another with the aid of an elasticity of the synthetic resin forming the corner pad, whereby the engagement of the engaging pieces maintain the superposed condition of said two hollow bodies.

3. A corner pad as set forth in claim 1, wherein after said protrusion has been fitted in said opening, the protrusion is at least partially collapsed so as to extend its extreme end which anchors at said opening.

4. A corner pad as set forth in claim 1, wherein each hollow body includes a small aperture communicating with an inner space in the hollow body.

5. A corner pad as set forth in claim 1, wherein the two hollow bodies other than the two hollow bodies to be superposed in said erected condition include a plurality of recesses in their surfaces facing outwardly in said erected condition to form reinforcing ribs by the remaining portions.

6. A corner pad as set forth in claim 1, wherein one of said superposing hollow bodies is formed in a surface confronting the other hollow body with a reinforcing ridge in the form of an L-shaped protrusion along edges of two surfaces adjacent at right angles to said surface and at right angles to each other in said erected condition.

7. A corner pad as set forth in claim 2, wherein the two hollow bodies other than the two hollow bodies to be supersposed in said erected condition include a plurality of recesses in their surfaces facing outwardly in said erected condition to form reinforcing ribs by the remaining portions.

8. A corner pad as set forth in claim 3, wherein the two hollow bodies other than the two hollow bodies to be superposed in said erected condition include a plurality of recesses in their surfaces facing outwardly in said erected condition to form reinforcing ribs by the remaining portions.

9. A corner pad as set forth in claim 4, wherein the two hollow bodies other than the two hollow bodies to be superposed in said erected condition include a plurality of recesses in their surfaces facing outwardly in said erected condition to form reinforcing ribs by the remaining portions.

10. A corner pad as set forth in claim 2, wherein one of said superposing hollow bodies is formed in a surface confronting the other hollow body with a reinforcing ridge in the form of an L-shaped protrusion along edges of two surfaces adjacent at right angles to said surface and at right angles to each other in said erected condition.

11. A corner pad as set forth in claim 3, wherein one of said superposing hollow bodies is formed in a surface confronting the other hollow body with a reinforcing ridge in the form of an L-shaped protrusion along edges of two surfaces adjacent at right angles to said surface and at right angles to each other in said erected condition.

12. A corner pad as set forth in claim 4, wherein one of said superposing hollow bodies is formed in a surface confronting the other hollow body with a reinforcing ridge in the form of an L-shaped protrusion along edges of two surfaces adjacent at right angles to said surface and at right angles to each other in said erected condition.

13. A corner pad as set forth in claim 5, wherein one of said superposing hollow bodies is formed in a surface confronting the other hollow body with a reinforcing ridge in the form of an L-shaped protrusion along edges of two surfaces adjacent at right angles to said surface and at right angles to each other in said erected condition.

* * * * *

UNITED STATES PATENT AND TRADEMARK OFFICE

CERTIFICATE OF CORRECTION

PATENT NO. : 4,407,898

DATED : October 4, 1983

INVENTOR(S) : KATO et al

It is certified that error appears in the above-identified patent and that said Letters Patent are hereby corrected as shown below:

On the title page the following should be added:

[30] Foreign Application Priority Data

February 28, 1981 [JP] Japan Utility Model 56-27605

July 31, 1981 [JP] Japan Utility Model 56-114305

Signed and Sealed this

Tenth Day of January 1984

[SEAL]

*Attest:*

GERALD J. MOSSINGHOFF

*Attesting Officer*

*Commissioner of Patents and Trademarks*